US009601881B2

(12) United States Patent
Lee et al.

(10) Patent No.: US 9,601,881 B2
(45) Date of Patent: Mar. 21, 2017

(54) REFRIGERATOR

(71) Applicant: LG ELECTRONICS INC., Seoul (KR)

(72) Inventors: Seungho Lee, Seoul (KR); Jaeyoul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/932,358

(22) Filed: Nov. 4, 2015

(65) Prior Publication Data

US 2016/0134064 A1 May 12, 2016

(30) Foreign Application Priority Data

Nov. 10, 2014 (KR) ..... 10-2014-0155710

(51) Int. Cl.
*H01R 13/60* (2006.01)
*H01R 13/73* (2006.01)
(Continued)

(52) U.S. Cl.
CPC ..... *H01R 13/73* (2013.01); *F25D 23/028* (2013.01); *F25D 23/065* (2013.01);
(Continued)

(58) Field of Classification Search
CPC ..... H01R 13/73; H01R 13/42; F25D 2400/40; F25D 2327/00; F25D 25/025; F25D 23/028; F25D 27/00; F25D 23/065; F25D 23/005
(Continued)

(56) References Cited

U.S. PATENT DOCUMENTS 5,056,688 A * 10/1991 Goetz ..... F25C 5/005 222/146.6
5,261,248 A * 11/1993 Willis ..... F25C 5/08 62/137
(Continued)

FOREIGN PATENT DOCUMENTS

EP 2 354 735 A2 8/2011
EP 2 765 377 A2 8/2014
(Continued)

OTHER PUBLICATIONS

European Search Report issued in Application No. 15192740.7 dated Apr. 6, 2016.
(Continued)

*Primary Examiner* — Jean F Duverne
(74) *Attorney, Agent, or Firm* — KED & Associates LLP

(57) ABSTRACT

The present invention discloses a refrigerator including a refrigerator main body having an opening, a door connected to the refrigerator main body and configured to open and close the opening, a storage unit configured to be moved toward a rear wall within the refrigerator main body so as to be installed in the refrigerator main body, the rear wall facing the opening, a power supply unit mounted at the rear wall and having an accommodating portion formed to face the opening, and a connection unit mounted at the storage unit, wherein when the storage unit is moved to the rear wall and installed in the refrigerator main body, at least part of the connection unit is inserted into the accommodating portion so as to be electrically connected to the power supply unit.

19 Claims, 9 Drawing Sheets

(51) Int. Cl.

| | |
|---|---|
| ***F25D 25/02*** | (2006.01) |
| ***F25D 23/02*** | (2006.01) |
| ***F25D 23/06*** | (2006.01) |
| ***F25D 27/00*** | (2006.01) |
| ***H01R 13/42*** | (2006.01) |

(52) U.S. Cl.
CPC ..... *F25D 25/025* (2013.01); *F25D 27/00* (2013.01); *H01R 13/42* (2013.01); *F25D 2327/00* (2013.01); *F25D 2400/40* (2013.01)

(58) Field of Classification Search
USPC ..... 439/529
See application file for complete search history.

(56) References Cited

U.S. PATENT DOCUMENTS

| | | | | |
|---|---|---|---|---|
| 6,050,097 | A * | 4/2000 | Nelson | F25C 5/005 62/137 |
| 6,053,472 | A * | 4/2000 | DeLand | F02M 25/0836 251/129.11 |
| 6,464,526 | B1 | 10/2002 | Seufert et al. | |
| 7,266,957 | B2 * | 9/2007 | Anderson | F25C 1/04 62/135 |
| 7,784,888 | B2 * | 8/2010 | Oh | A47B 51/00 312/223.6 |
| 8,966,926 | B2 * | 3/2015 | Eveland | F25C 5/005 362/92 |
| 9,175,898 | B2 * | 11/2015 | Chae | F25D 17/065 |
| 9,373,210 | B2 * | 6/2016 | Wittern, Jr. | F25D 17/065 |
| 2007/0074527 | A1 * | 4/2007 | Lee | F25C 5/005 62/344 |
| 2007/0103940 | A1 * | 5/2007 | Chung | F25C 5/187 363/16 |
| 2007/0109764 | A1 * | 5/2007 | Bienick | A47B 97/00 362/92 |
| 2009/0302724 | A1 | 12/2009 | Allard et al. | |
| 2010/0176703 | A1 | 7/2010 | Kim | |
| 2012/0230015 | A1 | 9/2012 | Zhu et al. | |
| 2014/0140040 | A1 | 5/2014 | Giacomini et al. | |
| 2014/0320040 | A1 | 10/2014 | Katu et al. | |

FOREIGN PATENT DOCUMENTS

| | | | |
|---|---|---|---|
| EP | 2 765 379 | A2 | 8/2014 |
| KR | 10-0123411 | B1 | 9/1997 |
| KR | 10-2010-0085230 | A | 7/2010 |
| WO | WO 03/034548 | A1 | 4/2003 |
| WO | WO 2012/008749 | A2 | 1/2012 |

OTHER PUBLICATIONS

Korean Office Action issued in Application No. 10-2014-0155710 dated Feb. 17, 2016.

* cited by examiner

REFRIGERATOR

CROSS-REFERENCE TO RELATED APPLICATION

Pursuant to 35 U.S.C. §119(a), this application claims the benefit of earlier filing date and right of priority to Korean Application No. 10-2014-0155710, filed Nov. 10, 2014, the subject matter of which is incorporated herein by reference.

BACKGROUND

1. Field

Embodiments may relate to a refrigerator having a power supply structure to a storage unit.

2. Background

A refrigerator is an apparatus that keeps foods therein at low temperature using cold air generated by a refrigerating cycle including a compressor, a condenser, an expansion valve and an evaporator.

A refrigerator is provided with at least one storage unit (e.g., a shelf, a tray, a basket, etc.) for efficiently using an inner storage space. For example, the shelves and the trays may be installed in a refrigerator main body and the baskets may be disposed on an inner surface of a door connected to the refrigerator main body.

The refrigerator may also be provided with a lighting device for illuminating an inside thereof, a display device for outputting information, and/or the like. Researches on a power supply structure for lights of the storage unit are undergoing from the perspective of user convenience and attractive appearance.

However, for a drawer-type storage unit, which is installed by being pushed from outside to inside of the refrigerator, a power supply structure using a cable may be difficult in assembly. Additionally, sealing of the power supply structure may be important in view of a humid inner environment of the refrigerator.

BRIEF DESCRIPTION OF THE DRAWINGS

Arrangements and embodiments may be described in detail with reference to the following drawings in which like reference numerals refer to like elements and wherein.

DETAILED DESCRIPTION

Embodiments may be explained in more detail with reference to the attached drawings. For the sake of brief description with reference to the drawings, the same or equivalent components may be provided with the same reference numbers, and description thereof may not be repeated. The suffixes "module" and "unit or portion" for components used in the following description merely provided only for facilitation of preparing this specification, and thus they are not granted a specific meaning or function. Furthermore, it should also be understood that embodiments are not limited by any of the details of the foregoing description, but rather should be construed broadly within its spirit and scope and it is intended that embodiments cover modifications and variations provided they come within the scope of the appended claims and their equivalents.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be connected with the other element or intervening elements may also be present. In contrast, when an element is referred to as being "directly connected with" another element, there are no intervening elements present.

A singular representation may include a plural representation unless it represents a definitely different meaning from the context.

Terms such as "include" or "has" are used herein and should be understood that they are intended to indicate an existence of several components, functions or steps, disclosed in the specification, and it is also understood that greater or fewer components, functions, or steps may likewise be utilized.

Figure 1:
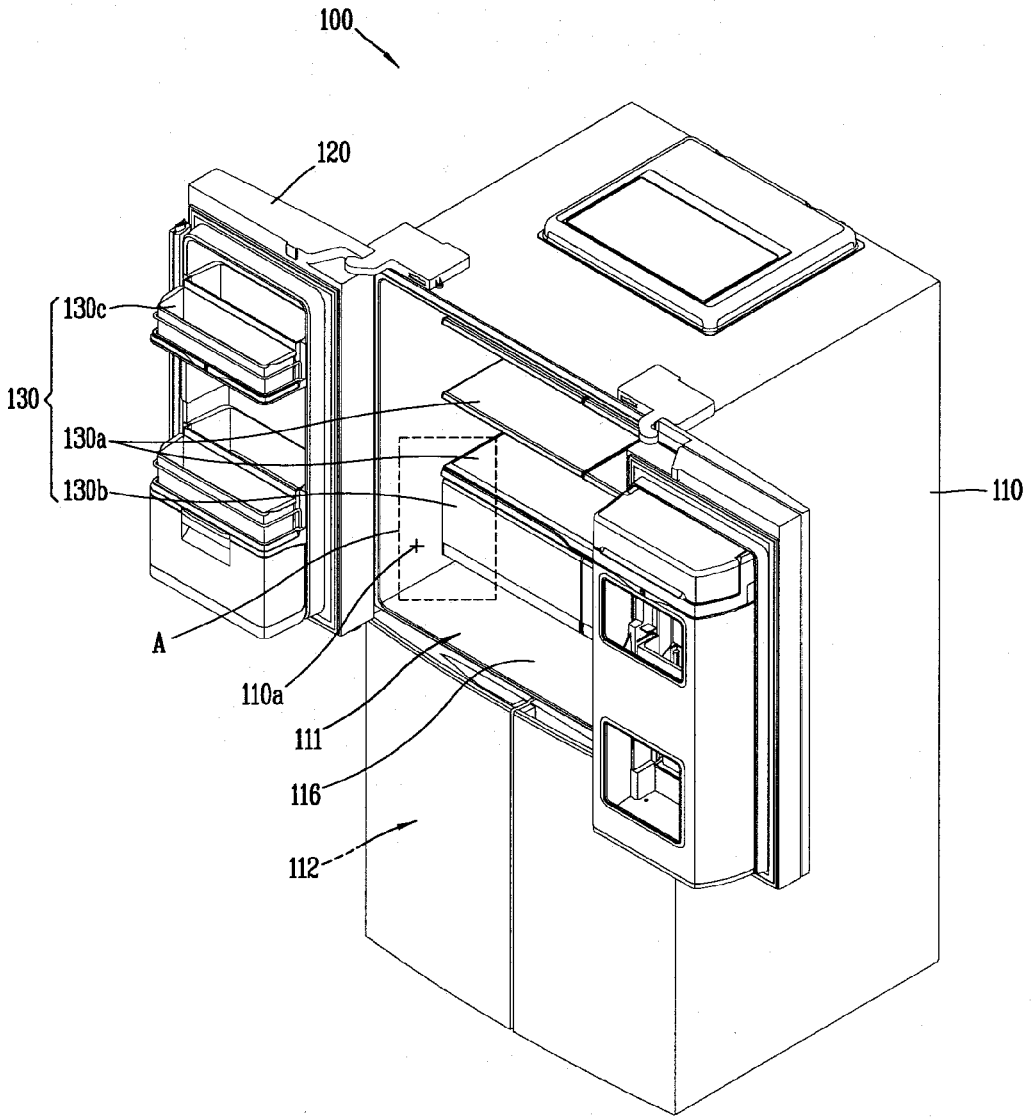
FIG. 1 is a perspective view illustrating an example of a refrigerator in accordance with an embodiment.
Figure 2:
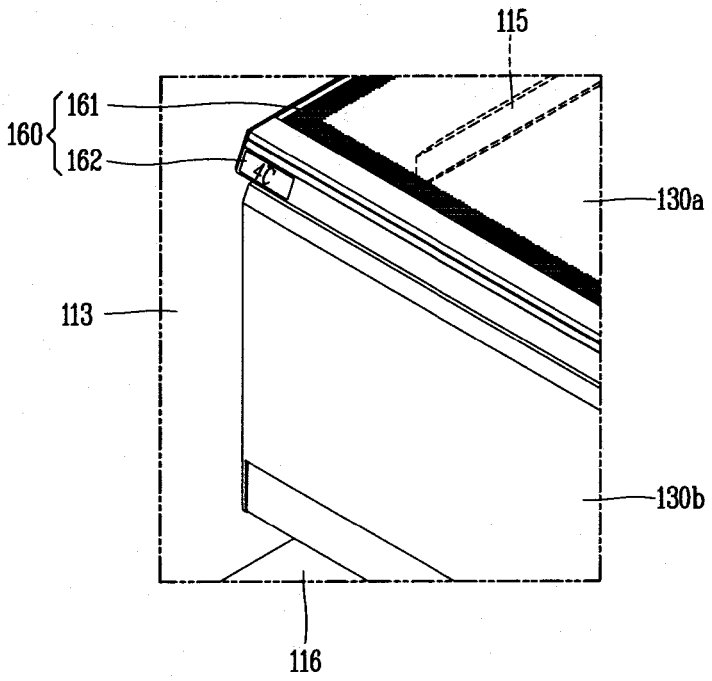
FIG. 2 is an enlarged view of part A shown in FIG. 1.

FIG. 1 is a perspective view illustrating an example of a refrigerator 100 in accordance with an example embodiment. FIG. 2 is an enlarged view of part A shown in FIG. 1. Other embodiments and configurations may also be provided.

This exemplary embodiment shows a bottom freezer type refrigerator 100 in which a refrigerator chamber 111 is located at an upper portion and a freezing chamber 112 is located at a lower portion of a refrigerator main body, although embodiments are not limited to this structure. Embodiments may also be applied to a side by side type refrigerator in which a refrigerating chamber and a freezing chamber are arranged side by side, and/or a top mount type refrigerator in which a freezing chamber is located above a refrigerating chamber.

As shown in FIG. 1, a refrigerator main body 110 is provided with a storage space for storing (keeping) foods therein. The storage space may be divided into a refrigerating chamber 111 and a freezing chamber 112 according to a set temperature.

A door 120 may be connected to the refrigerator main body 110 so as to open or close a front opening 110*a* of the refrigerator main body 110. The door 120 may be configured into various shapes, such as a rotating door that is rotatably connected to the refrigerator main body 110, and/or a drawer-type door that is slidably coupled to the refrigerator main body 110.

The refrigerator 100 is provided with at least one storage unit (or accommodation unit) 130 (e.g., a shelf 130*a*, a tray 130*b*, a basket 130*c*, etc.) for efficient use of its inner storage space. For example, the shelf 130*a* and the tray 130*b* may be disposed in the refrigerator main body 110, and the basket 130*c* may be disposed at an inner side of the door 120 connected to the refrigerator main body 110. The storage unit may also be referred to as a storage device.

The shelf 130*a* may have a shape of a plate, and the shelf 130 may be horizontally installed in the refrigerator main body 110 for foods to be placed thereon. The shelf 130*a* may be supported by guide portions 115 provided at both side walls 113 in the refrigerator main body 110. A rear end portion of the shelf 130*a* may be fixedly engaged with a rail, which is installed on a rear wall 114 within the refrigerator main body 110.

The tray 130*b* may form a space, which is isolated from other storage space within the refrigerator 100, to store foods therein. The tray 130*b* may be formed in a shape of a box with an upper opening. When the tray 130*b* is pushed into the refrigerator 100, the upper opening is obscured by the above shelf 130*a*, and accordingly a hermetic space is formed therein. The tray 130*b* may be supported on an inner bottom surface 116 of the refrigerator main body 110, and the tray 130*b* may be configured to be slidable on the bottom surface 116 upon installation thereof.

The storage unit 130 may be configured as a drawer type. Accordingly, when the storage unit 130 is installed, the storage unit 130 may be moved to the inner rear wall 114 of the refrigerator main body 110 facing the opening 110*a*. The guide portions 115 may guide movement of the storage unit 130 toward the rear wall 114.

The guide portions 115 may extend from the opening 110*a* toward the rear wall 114. The guide portions 115 may be formed in a manner of bending an inner case of the refrigerator main body 110, or may be fabricated as separate members and installed at both side walls 113 within the refrigerator main body 110.

The guide portions 115 may support a lower surface of the storage unit 130 at both sides of the storage unit 130. That is, the guide portions 115 may be configured to guide movement of the storage unit 130 during an installation process and support the installed storage unit 130.

The guide portions 115 may further be provided to cover an upper surface of the storage unit 130 at both sides of the storage unit 130. With this structure, an up-and-down (vertical) movement of the storage unit 130 may be restricted during the installation process of the storage unit 130. This may allow a power supply unit 140 and a connection unit 150 to be coupled to each other at an accurate position.

An electronic device 160 may be mounted at the storage unit 130. For example, the electronic device 160 may be a lighting device 161 for illuminating the storage unit 130, and/or a display device 162 disposed on the storage unit 130 to output information.

Explaining an example that the lighting device 161 is installed at the storage unit 130, a light source may be installed at the storage unit 130, to emit light in response to power supplied thereto when the power supply unit 140 and the connection unit 150 are electrically connected to each other. The light source may be a high-brightness light emitting diode (LED), for example.

A light guide member may be provided adjacent to the light source to guide light emitted from the light source. That is, light emitted from the light source is dispersed by the light guide member so as to illuminate the storage unit 130. For example, the light guide member may be formed in a loop shape extending along an edge of an upper surface of the storage unit 130 to illuminate the edge of the upper surface.

There is an example of requiring an electric connection to the electronic device 160 provided at the storage unit 130. However, for a drawer-type storage unit 130 that is installed in a manner of being pushed from outside to inside of the refrigerator 100, a power supply structure using a cable may be difficult to be assembled. Sealing of the power supply structure may be an important issue in view of the characteristic of a humid inner environment of the refrigerator 100.

Description may be provided of a power supply structure that can facilitate an electric connection between the refrigerator main body 110 and the storage unit 130, taking into account the installation method of the storage unit 130 and characteristic of the inner environment of the refrigerator 100.

Figure 3:
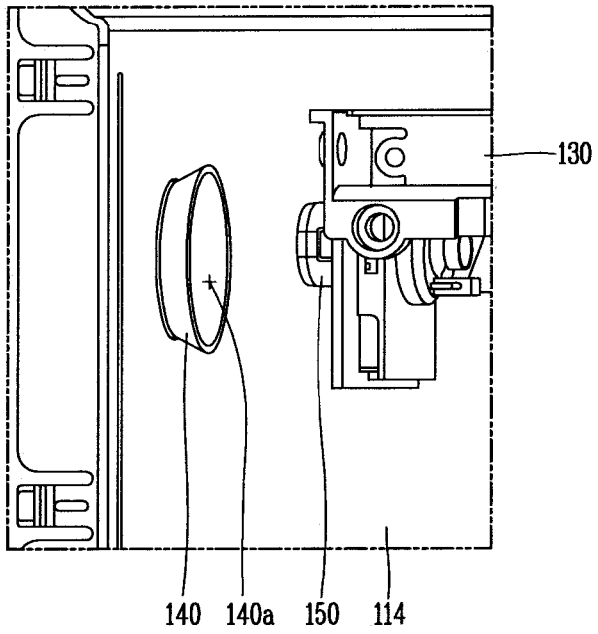
FIG. 3 is a conceptual view illustrating one exemplary embodiment that illustrates a state before a storage unit is installed in a refrigerator main body.

FIG. 3 is a conceptual view illustrating one exemplary embodiment that illustrates a state before the storage unit 130 is installed in the refrigerator main body 110. Other embodiments and configurations may also be provided.

As shown in FIG. 3, the storage unit 130 is installed in the refrigerator main body 110 in a manner of being inserted through the opening 110 toward the inner rear wall 114 of the refrigerator main body 110. The storage unit 130 may be moved toward the rear wall 114 while being horizontally balanced by virtue of the guide portions 115, as shown in FIG. 2. After completion of the installation, the storage unit 130 may be located in the refrigerator main body 110 in the horizontally-balanced state.

After being completely installed, the storage unit 130 may be disposed to be brought into contact with the rear wall 114 or adjacent to the rear wall 114 within a preset interval. The storage unit 130 may be supported by the guide portions 115, and fixed by being locked at the rail installed on the rear wall 114 in the refrigerator main body 110.

The power supply unit 140, which is electrically connected to a power source of the refrigerator main body 110, may be mounted to the rear wall 114 within the refrigerator main body 110. The power supply unit 140 may include an accommodating portion 140*a* in which at least part of the connection unit 150 is accommodated. The accommodating portion 140*a* may have a shape that is open toward the opening 110 of the refrigerator main body 110.

Upon installation, the connection unit 150 is mounted on a rear surface of the storage unit 130 that faces the rear wall 114. When the storage unit 130 is installed in the refrigerator main body 110 by being moved toward the rear wall 114, at least part of the connection unit 150 is inserted into the accommodating portion 140*a* to be electrically connected to the power supply unit 140. For example, when the storage unit 130 is brought into contact with the rear wall 114, the connection between the connection unit 150 and the power supply unit 140 may be realized.

With the structure, when the storage unit 130 is moved toward the rear wall 114 within the refrigerator main body 110 and completely installed thereat, the electrical connection between the power supply unit 140 and the connection unit 150 may be simultaneously carried out. Therefore, a power source connection process may not be separately needed, except for installation of the storage unit 130, which may result in improvement of assembly convenience.

Hereinafter, the power supply unit 140 and the connection unit 150 may be described in more detail.

Figure 4:
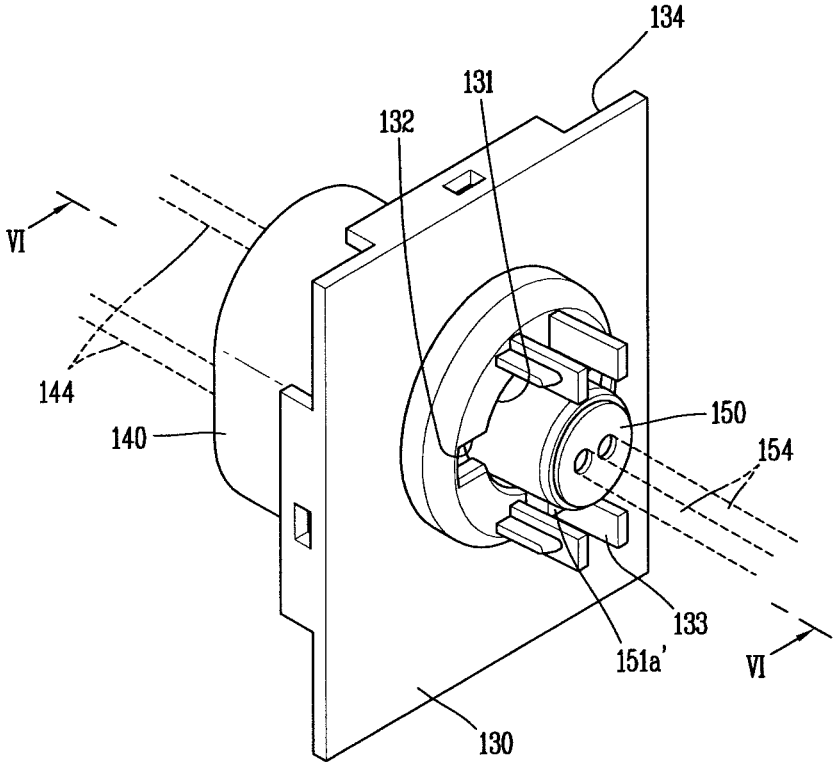
FIG. 4 is a conceptual view illustrating a state that a power supply unit and a connection unit of FIG. 3 are coupled to each other.
Figure 5:
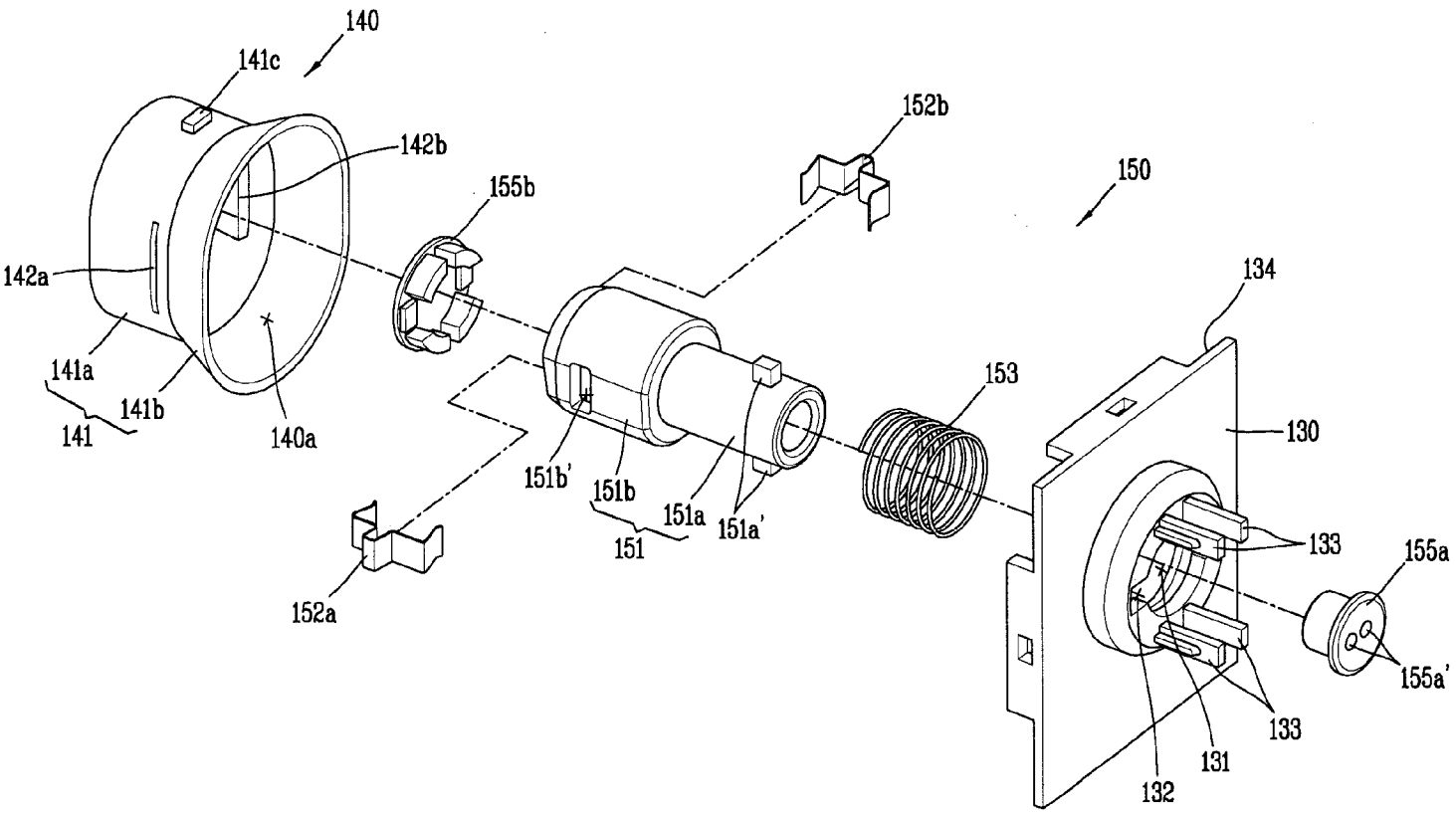
FIG. 5 is an exploded perspective view illustrating the power supply unit and the connection unit shown in FIG. 4.
Figure 6:
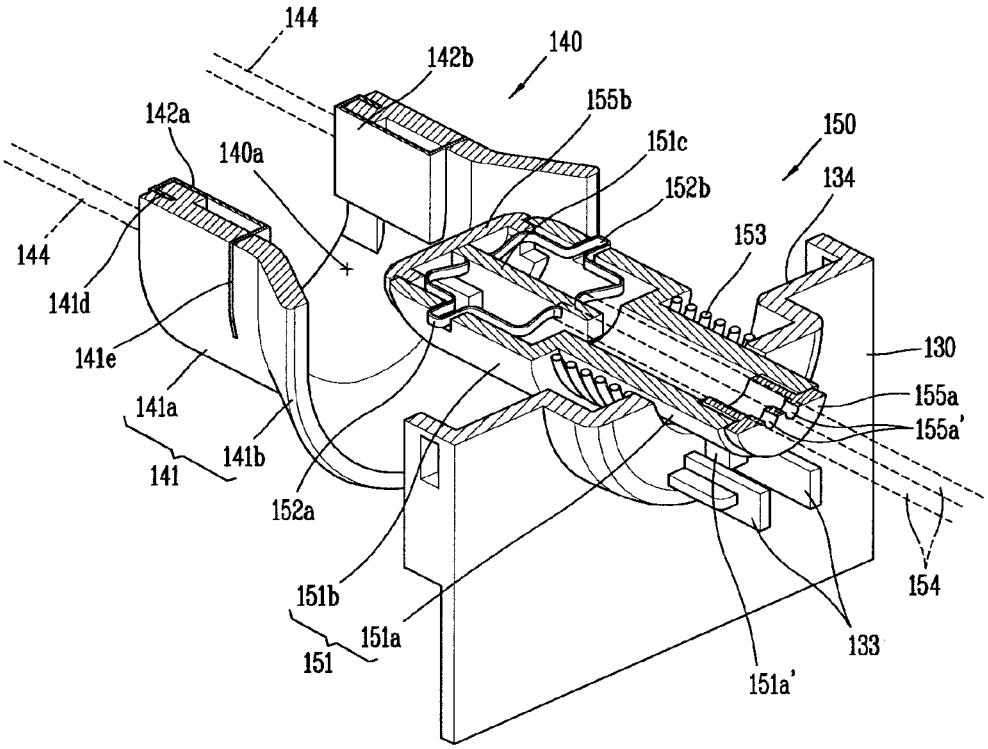
FIG. 6 is a sectional view taken along the line VI-VI of FIG. 4.
Figure 7:
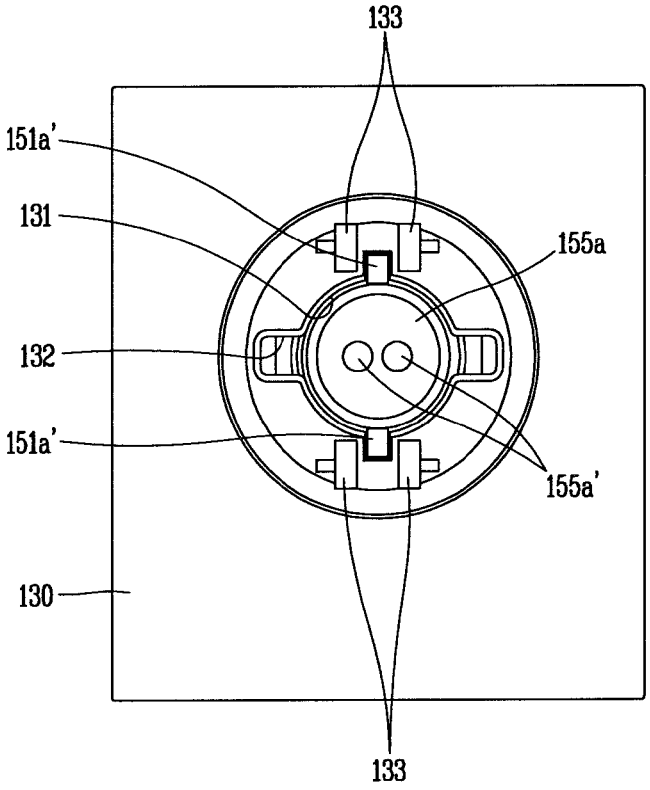
FIGS. 7 to 10 are front, top, bottom and side views of the power supply unit and the connection unit shown in FIG. 4.
Figure 8:
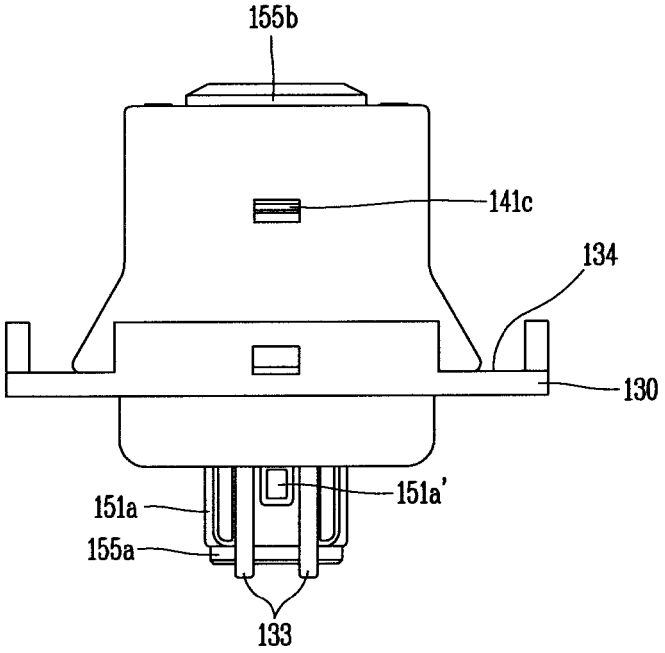

FIG. 4 is a conceptual view illustrating a state that the power supply unit 140 and the connection unit 150 of FIG. 3 are coupled to each other. FIG. 5 is an exploded perspective view illustrating the power supply unit 140 and the connection unit 150 shown in FIG. 4. FIG. 6 is a sectional view taken along line VI-VI of FIG. 4. FIG. 6 illustrates the power supply unit 140 and the connection unit 150 in a separated state for ease of explanation. Other embodiments and configurations may also be provided.

As shown in FIGS. 4 to 6, the power supply unit 140 may include a socket body 141, a first socket terminal 142*a* and a second socket terminal 142*b*.

The socket body 141 is mounted at the rear wall 114 within the refrigerator main body 110, and includes the accommodating portion 140*a* therein. The socket body 141 may be formed of a predetermined flexible material (e.g., polyurethane, rubber, silicon, etc.) for a more flexible connection between the power supply unit 140 and the connection unit 150.

The first and second socket terminals 142*a* and 142*b* are installed on the socket body 141 in a spaced manner. At least parts of the first and second socket terminals 142*a* and 142*b* may protrude to an inner side of the accommodating portion 140*a* so as to be brought into contact with first and second connection terminals 152*a* and 152*b* when the connection unit 140 is inserted into the accommodating portion 140*a*. The socket body 141 may further include a third socket terminal for grounding.

The accommodating portion 140*a* of the socket body 141 may have a shape in which even a rear side as well as a front side is open. A cover member 143 (see FIGS. 11A and 11B) may be coupled to the socket body 141 to cover the rear opening of the accommodating portion 140*a*.

The socket body 141 may include a first body portion 141*a* and a second body portion 141*b*.

The first body portion 141*a* may be formed in an annular shape and may be inserted into the refrigerator main body 110. A fixing protrusion 141*c*, by which the cover member 143 is locked when being mounted to the socket body 141, may be formed on an outer circumferential surface of the first body portion 141*a*.

The first and second socket terminals 142*a* and 142*b* may be installed in the first body portion 141*a*. However, embodiments are not limited to this. The first and second socket terminals 142*a* and 142*b* may also be installed over the first body portion 141*a* and the second body portion 141*b*. The drawings exemplarily illustrate that the first and second socket terminals 142*a* and 142*b* are disposed to face each other at left and right sides of the first body portion 141*a*.

The first body portion 141*a* may include first insertion recesses 141*d* and second insertion recesses 141*e* for fixing (or attaching) the first and second socket terminals 142*a* and 142*b*, respectively. The first and second insertion recesses 141*d* and 141*e* make one set to fix the first and second socket terminals 142*a* and 142*b*, respectively.

Both end portions of the socket terminals 142*a* and 142*b* may be inserted into the first and second insertion recesses 141*d* and 141*e*, respectively. A description may be exemplarily provided of the first socket terminal 142*a*. One end portion of the first socket terminal 142*a* may be inserted into the first insertion recess 141*d* and another end portion of the first socket terminal 142 may be inserted into the second insertion recess 141*e*. The first socket terminal 142*a* may have a shape in which both of the end portions thereof are bent.

The first insertion recess 141*d* and the second insertion recess 141*e* may extend in different directions from each other. With this structure, when a force is applied to the first socket terminal 142*a* in one direction, at least one of the one end portion and the another end portion of the first socket terminal 142*a* may be supported by at least one of the first and second insertion recesses 141*d* and 141*e*, whereby a separation of the first socket terminal 142*a* may be prevented.

Each of the first and second socket terminals 142*a* and 142*b* may be electrically connected to a power source of the refrigerator main body 110 through a wire 144. The wire 144 may be fixed at its position by being inserted or clamped into one of the first and second insertion recesses 141*d* and 141*e*. The drawings show that the wire 144 is inserted into the first insertion recess 141*d*, which is more adjacent to an inside of the refrigerator main body 110. A through hole 143*a* for an insertion of the wire 144 therethrough may be formed through the cover member 143.

The second body portion 141*b* may extend from the first body portion 141*a* to be outwardly inclined, to guide the insertion of the connection unit 150 into the first body portion 141*a*. That is, the second body portion 141*b* may have an annular shape in which an outer diameter increases toward an outer side.

An inner space of the first body portion 141*a* and an inner space of the second body portion 141*b* communicate with each other, and form the accommodating portion 141*a*. FIG. 3 illustrates that the first body portion 141*a* is inserted into the refrigerator main body 110 and the second body portion 141*b* protrudes from the inner rear wall 114 of the refrigerator main body 110.

The connection unit 150 includes a connector body 151, a first connection terminal 152*a* and a second connection terminal 152*b*.

The connector body 151 is mounted at the storage unit 130, and at least part thereof is inserted into the accommodating portion 140*a* upon installation of the refrigerator main body 110. The connector body 151, as shown in the drawings, may have a bar shape that extends in one direction (i.e., a direction from the opening 110*a* to the rear wall 114).

The first and second connection terminals 152*a* and 152*b* are mounted to the connector body 151, respectively, in a manner that at least part thereof is externally exposed. The first and second connection terminals 152*a* and 152*b* are brought into contact with the first and second socket terminals 142*a* and 142*b* provided at the power supply unit 140, respectively, when at least part of the connector body 151 is inserted into the accommodating portion 140*a*.

The part of the connector body 151 may be inserted into the storage unit 130 through a through hole 131 formed at the storage unit 130, and the connector body 151 may elastically be supported by an elastic member 153.

The connector body 151 may include a first part 151*a* and a second part 151*b*. The first part 151*a* is a part that is insertable through the through hole 131, and the second part 151*b* is a part extending to have a sectional area greater than that of the first part 151*a*. The second part 151*b* is preferably formed to have an outer diameter greater than a diameter of the through hole 131. According to this shape, a sectional area of the connector body 151 may have a shape like an alphabet 'T.'

The first and second connection terminals 152*a* and 152*b* are installed at the second part 151*b*, respectively. This embodiment illustrates that the first and second connection terminals 152*a* and 152*b* are installed within the second part 151*b*, respectively, in a manner that at least part of each of the first and second connection terminals 152*a* and 152*b* protrudes from an outer circumference of the second part 151*b* through a hole 151*b*' formed through the second part 151*b*.

As shown, the elastic member 153 surrounds the first part 151*a* and is supported by the second part 151*b* and the storage unit 130. The elastic member 153 may be configured as a spring, a urethane foam, and/or the like.

With the structure, when an external force is applied to press the connector body 151 into the storage unit 130, the connector body 151 may be inserted more into the storage unit 130. When the external force is released, the connector body 151 may be drawn out of the storage unit 130.

In order to install and fix the connector body 151 at the storage unit 130, the following structure may be provided.

Insertion holes 132 communicating with the through hole 131 are formed at the storage unit 130, and protrusions 151*a*' corresponding to the insertion holes 132 protrude from an outer circumference of the first part 151*a* of the connector body 151.

To install (couple) the connector body 151 in (to) the storage unit 130, the connector body 151 may be positioned in a manner that the protrusions 151*a*' face (are aligned with) the insertion holes 132 and thereafter the first part 151*a* is inserted into the storage unit 130 through the through hole 131. When the connector body 151 is rotated after the protrusions 151*a*' are inserted through the insertion holes 132, the protrusions 151*a*' are locked by the storage unit 130, thereby preventing a withdrawal (separation) of the connector body 151.

Ribs 133 may be disposed at the storage unit 130. The ribs 133 may cover both sides of the protrusions 151*a*' locked by the storage unit 130, respectively. With the structure, the protrusions 151*a*' are locked by the ribs 133 upon rotation of the connector body 151, thereby restricting rotation of the connector body 151.

Referring to FIG. 6, a partition wall 151*c* may be provided in the second part 151*b* to partition an inner space of the second part 151*b* into a space for installation of the first connection terminal 152*a* and a space for installation of the second connection terminal 152*b*. The partition wall 151*c* may be made of an insulating material. Both side surfaces of the partition wall 151*c* may support the first connection terminal 152*a* and the second connection terminal 152*b*. The partition wall 151*c* may be disposed to face holes 151*b*' of the second part 151*b*.

A related detailed structure based on the first connection terminal 152*a* may be described hereinafter. The first connection terminal 152*a* may have a clip shape that a thin metal plate is bent. Both end portions of the first connection terminal 152*a* may be supported by the partition wall 151*c* and at least part of the first connection terminal 152*a* may protrude from an outer circumference of the second part 151*b* through the hole 151*b*'.

When the first connection terminal 152*a* contacts the first socket terminal 142*a*, the at least part of the first connection terminal 152*a* that has protruded through the hole 151*b*' is inserted back into the second part 151*b* by an external force. Both end portions of the first connection terminal 152*a* may be elastically supported by the partition wall 151*c*. Accordingly, the at least part of the first connection terminal 152*a* can be maintained in the contact state with the first socket terminal 142*a*.

The structure of the first and second connection terminals 152*a* and 152*b* may not be limited to the clip shape shown in this embodiment. The first and second connection terminals 152*a* and 152*b* may be formed in another clip shape or a shape of a pogo pin.

The wires 154 are connected to the first and second connection terminals 152*a* and 152*b*. The wires 154 may extend into the storage unit 130 through the first part 151*a*, and may be electrically connected to the electronic device 160 provided in the storage unit 130. The electronic device 160 may be a lighting device 161 for illuminating the storage unit 130, a display device disposed on the storage unit 130 to output information, and/or the like.

The power supply unit 140 and the connection unit 150 may have the following structure to seal an inner space thereof for an electric connection.

The connector body 151 may include a first cover 155*a* and a second cover 155*b* for sealing the inner space.

The first cover 155*a* may be disposed to cover an opening formed at the first part 151*a*, and may include holes 155*a*' through which the wires 154 electrically connected to the first and second connection terminals 152*a* and 152*b* are inserted.

The second cover 155*b* may be disposed to cover an opening that is formed at the second part 151*b* to connect the first and second connection terminals 152*a* and 152*b* therethrough.

The first and second covers 155*a* and 155*b* may be installed at the connector body 151 to be fixedly adhered onto the first and second parts 151*a* and 151*b*, respectively. The first and second covers 155*a* and 155*b* may be formed of a material, such as rubber, silicon and/or the like.

A sealing member, in an annular shape, may be provided between the first cover 155*a* and the first part 151*a* and between the second cover 155*b* and the second part 151*b*. The sealing member may be made of a material, such as rubber, silicon and/or the like. The sealing member may be closed adhered between the first cover 151*a* and the first part 151*a* and between the second cover 155*b* and the second part 151*b*, when the first and second covers 155*a* and 155*b* are installed at the connector body 151, thereby sealing the inner space of the connector body 151.

The second body portion 141*b* of the socket body 141 may be closely adhered onto one surface of the storage unit 130 upon electric connection between the power supply unit 140 and the connection unit 150. This structure may allow for sealing the inner space for the electric connection between the power supply unit 140 and the connection unit 150, which may result in preventing an introduction of humid air into the inner space.

A process of coupling the power supply unit 140 and the connection unit 150 to each other may be described in more detail.

FIGS. 7 to 10 are front, top, bottom and side views of the power supply unit 140 and the connection unit 150 shown in FIG. 4. FIGS. 11A and 11B are sectional views illustrating a state before the connection unit 150 is coupled to the power supply unit 140 and a coupled state thereof. Other embodiments and configurations may also be provided.

Description may be briefly provided of a coupling process between the power supply unit 140 and the connection unit 150 shown in FIGS. 11A and 11B, with reference to FIGS. 7 to 10. When the storage unit 130 is inserted into the refrigerator main body 110 toward the rear wall 114 for installation, the connection unit 150 is moved toward the power supply unit 140 that it faces. When the installation of the storage unit 130 is completed, at least part of the connection unit 150 is accommodated in the accommodating portion 140*a* and the first and second connection terminals

152*a* and 152*b* are brought into contact with the first and second socket terminals 142*a* and 142*b*. Accordingly, the power supply unit 140 and the connection unit 150 are electrically connected to each other.

The storage unit 130 may have a width corresponding to a distance between both side walls 113 within the refrigerator main body 110. With the structure, during a process of inserting in the storage unit 130 toward the rear wall 114, the storage unit 130 is guided to be moved toward the rear wall 114 by the both side walls 113, while being restricted from moving in left and right directions.

On the other hand, while the storage unit 130 is inserted toward the rear wall 114, a predetermined movement of the storage unit 130 may occur in up and down directions. The socket body 141 may be provided with the second body portion 141*b* that extends to be outwardly inclined, so as to guide the connection unit 150, which is moved toward the rear wall 114 with an assembly variation in the up and down directions, into the first body portion 141*a*.

The second body portion 141*b* may be configured, taking the assembly variation into account, such that a width in the up and down directions thereof may be wider than a width in the left and right directions. The first body portion 141*a* may also extend in the up and down directions to correspond to the second body portion 141*b*. That is, the first body portion 141*a* may have a length in the up and down direction that is longer than the width of the connection unit 150 in the up and down directions.

The first and second socket terminals 142*a* and 142*b* are arranged to face each other within the accommodating portion 140*a*. Taking into account the movement of the storage unit 130 in the up and down directions, the first and second socket terminals 142*a* and 142*b* are preferably installed at left and right sides of the socket body 141. Additionally, each of the first and second socket terminals 142*a* and 142*b* may extend in the up and down directions of the socket body 141, by considering the assembly variation of the connection unit 150 in the up and down directions.

Figure 9:
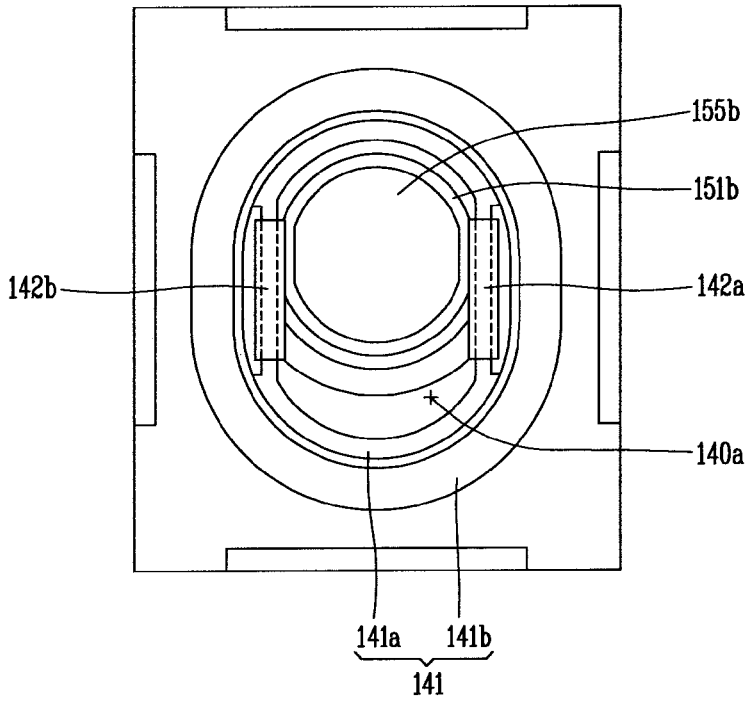
Figure 10:
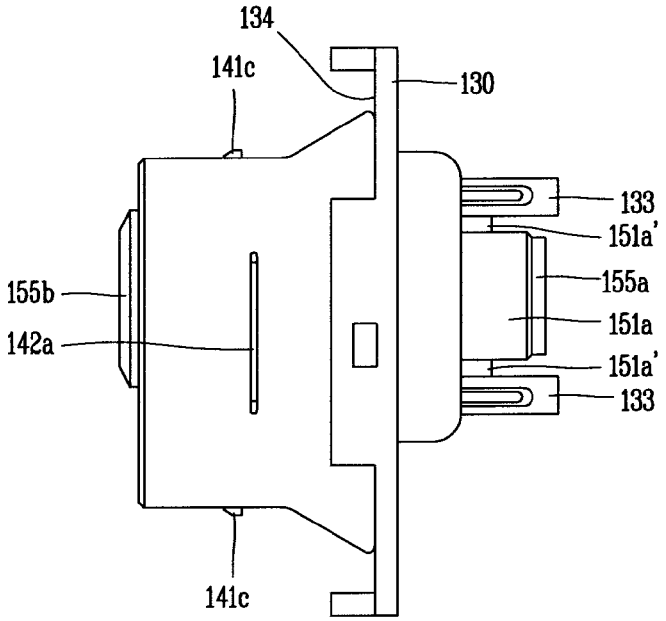
Figure 11A:
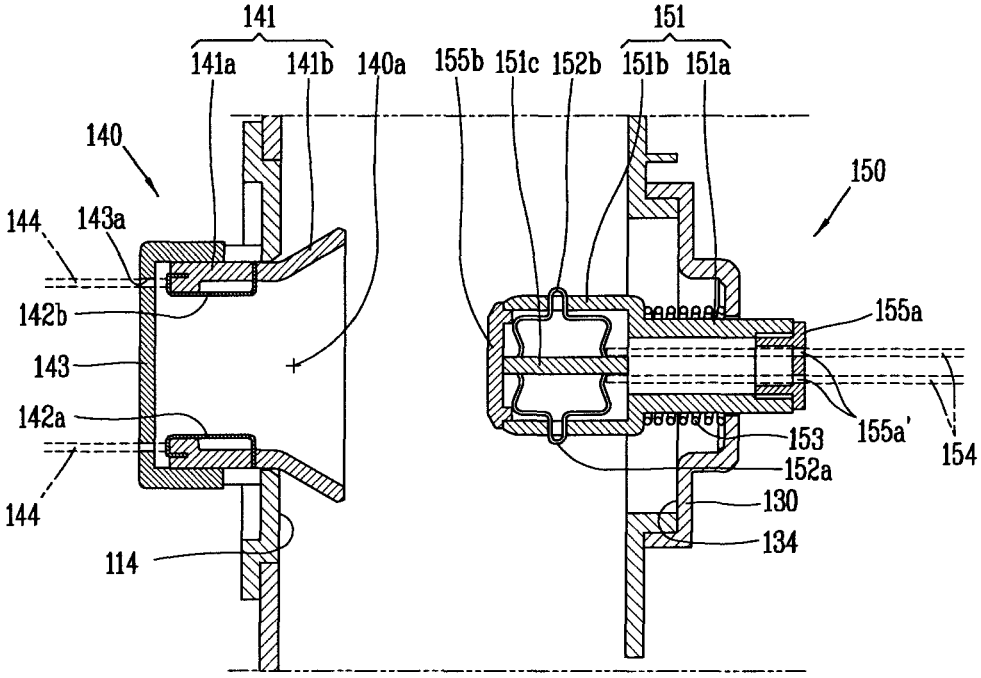
FIGS. 11A and 11B are sectional views illustrating a state before the connection unit is coupled to the power supply unit and a coupled state thereof.
Figure 11B:
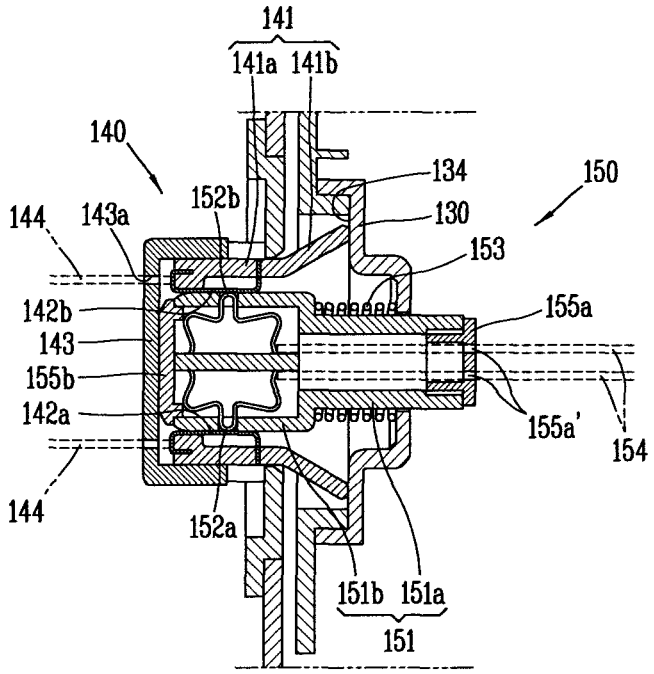

FIGS. 9 and 10 illustrate that the first and second socket terminals 142*a* and 142*b* extend in the up and down directions from left and right sides of the first body portion 141*a*, respectively, and the connector body 151 is inserted in an upper side of the accommodating portion 140*a*.

The connector body 151 may be elastically supported by the elastic member 153. With the structure, during the coupling process between the power supply unit 140 and the connection unit 150, the connector body 151 is inserted into the storage unit 130 and coming in contact with an inner side of the second body portion 141*b*. When the connector body 151 is accommodated in the first body portion 141*a*, then the connector body 151 is drawn out of the storage unit 130. A predetermined gap may be formed between the first part 151*a* and the through hole 131. This may allow the connector body 151 to be tilted from an axis of the through hole 131 by a predetermined value.

A recess portion 134 may be formed at a rear surface of the storage unit 130 facing the rear wall 114. Accordingly, upon coupling the power supply unit 140 and the connection unit 150 to each other, at least part of the second body portion 141*b* may be accommodated in the recess portion 134. With the structure, when the storage unit 130 is moved toward the rear wall 114 within the refrigerator main body 110 and completely installed thereat, the second body portion 141*b* may be closely adhered onto the recess portion 134, thereby sealing an inner space for the electric connection between the power supply unit 140 and the connection unit 150.

Different embodiments may be described. Structures that have not been specified in description of different embodiments may be understood by structures of previously-described embodiments.

Figure 12:
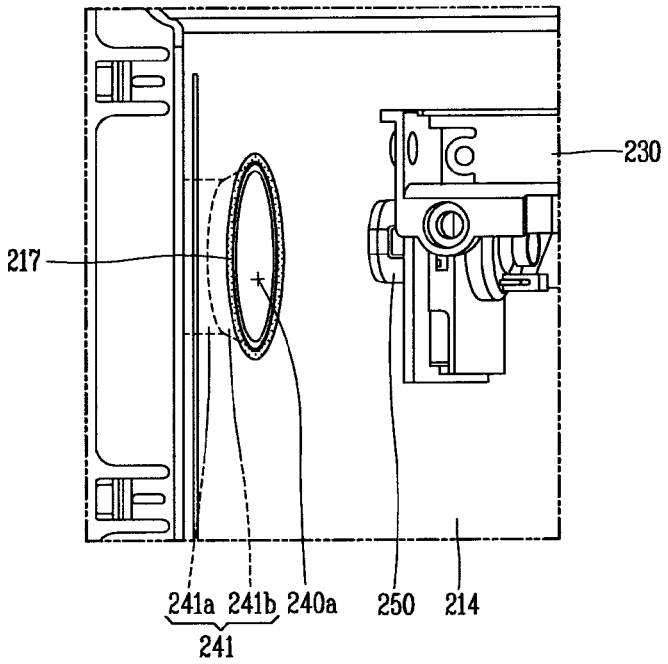
FIG. 12 is a conceptual view illustrating an exemplary embodiment that illustrates a state before a storage unit is installed in a refrigerator main body.

FIG. 12 is a conceptual view illustrating an exemplary embodiment that illustrates a state before a storage unit 230 is installed in a refrigerator main body 210. Other embodiments and configurations may also be provided.

As shown in FIG. 12, a socket body 241 may include a first body portion 241*a* and a second body portion 241*b*. In the previous exemplary embodiment, the first body portion 141*a* is inserted into the refrigerator main body 110 and the second body portion 141*b* protrudes from the rear wall 114 within the refrigerator main body 110.

This embodiment may illustrate that both of first and second body portions 241*a* and 241*b* are inserted into a refrigerator main body 210. That is, when viewing the inside of the refrigerator main body 210 through an opening, only an accommodating portion 240*a* may be viewed with an outer appearance of a socket body 241 being invisible.

In order to seal an inner space for an electric connection between a power supply unit 240 and a connection unit 250, a sealing member 217 in a loop shape to surround the second body 241*b* may be disposed on a rear surface of a rear wall 214 or a storage unit 230. For example, when the sealing member 217 is disposed on the rear wall 214, upon completely installing the storage unit 230 by moving to the rear wall 214 within the refrigerator main body 210, the sealing member 217 may be closely adhered onto the storage unit 230.

Figure 13:
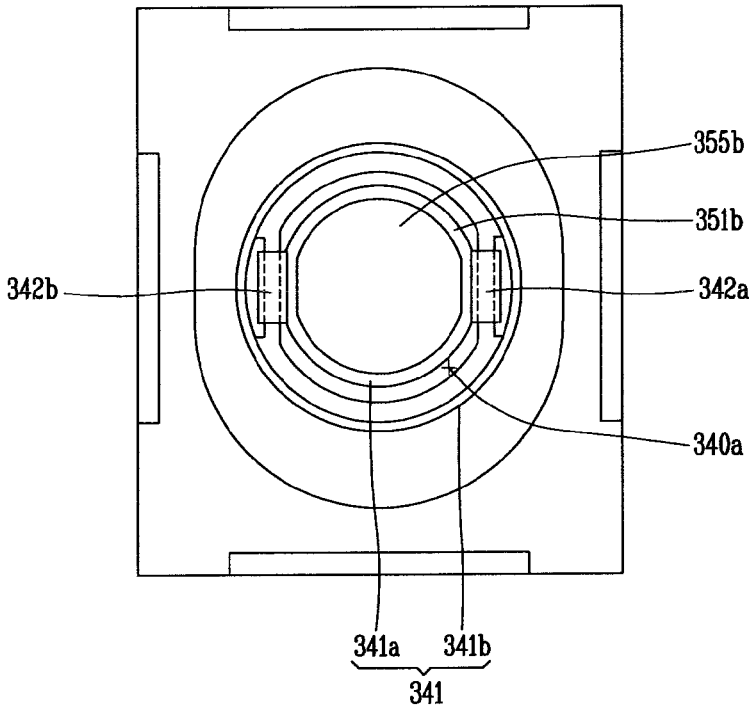
FIG. 13 is a view of an exemplary embodiment that illustrates a power supply unit and a connection unit, viewed from a rear surface of the power supply unit.

FIG. 13 is a view of an exemplary embodiment that illustrates a power supply unit 340 and a connection unit 350, viewed from a rear surface of the power supply unit 340. In this drawing, a cover member is omitted for the sake of explanation. Other embodiments and configurations may also be provided.

As shown in FIG. 13, a socket body 341 includes a first body portion 341*a* and a second body portion 341*b*. The second body portion 341*b* may extend in up and down directions to guide an insertion of a connection unit 350 that moves toward a rear wall 314 with an assembly variation in the up and down directions.

With regard to the first body portion 341*a*, the previous exemplary embodiment has illustrated that the first body portion 141*a* extends in the up and down directions to correspond to the second body portion 141*b*. However, this exemplary embodiment may be configured such that the first body portion 341*a* can have a shape corresponding to a second portion 351*b* of a connector body 351. For example, as illustrated in FIG. 13, the first body portion 341*a* may be formed in a circular shape with a predetermined radius.

An aspect of the detailed description may be to provide a power supply structure, capable of facilitating an electric connection between a refrigerator main body and a storage unit, taking into account an installation method of the storage unit and an inner environment of the refrigerator.

To achieve these and other advantages and in accordance with this specification, as embodied and broadly described herein, there is provided a refrigerator including a refrigerator main body having an opening, a door connected to the refrigerator main body and configured to open and close the opening, a storage unit configured to be moved toward a rear wall within the refrigerator main body so as to be installed in the refrigerator main body, the rear wall facing the opening. Additionally, a power supply unit may be mounted at the rear wall and have an accommodating portion formed to face the opening, and a connection unit may be mounted at the storage unit. When the storage unit is moved to the rear wall and installed in the refrigerator main body, at least part of the connection unit is inserted into the accommodating portion so as to be electrically connected to the power supply unit.

In one exemplary embodiment, the power supply unit may include a socket body mounted at the rear wall and forming the accommodating portion therein. A first socket terminal and a second socket terminal may be installed at the socket body and each have at least part protruding into the accommodating portion. The first and second socket terminals may be spaced apart from each other.

The storage unit may include a recess portion recessed into a rear surface facing the rear wall, such that at least part of the socket body is accommodated therein when the power supply unit and the connection unit are electrically connected to each other.

The socket body may include a first body portion at which the first socket terminal and the second socket terminal are disposed, respectively, and a second body portion extending from the first body portion to be externally inclined and configured to guide an insertion of the connection unit.

The first body portion may include first insertion recesses and second insertion recesses, in which one end portions and another end portions of the first and second socket terminals are inserted, respectively, such that the first and second socket terminals are fixed.

The first insertion recess and the second insertion recess may extend in different directions from each other.

The power supply unit may further include wires inserted into one of the first and second insertion recesses and electrically connected to the first and second socket terminals, respectively.

The second body portion may be closely adhered onto one surface of the storage unit upon the electric connection between the power supply unit and the connection unit.

The storage unit may have a width corresponding to a distance between both side walls in the refrigerator main body, to be guided by the both side walls to move toward the rear wall upon installation in the refrigerator main body. The second body portion may be configured such that a width thereof in up and down directions is wider than a width thereof in left and right directions.

The first body portion may be configured such that a width thereof in the up and down directions is wider than a width of the connection unit in the up and down directions.

The first and second socket terminals may be disposed at left and right sides of the first body portion to face each other. Each of the first and second socket terminals may extend in the up and down directions of the first body portion.

In another exemplary embodiment, the connection unit may include a connector body mounted at the storage unit and configured such that at least part thereof is inserted into the accommodating portion when the storage unit is installed in the refrigerator main body, and a first connection terminal and a second connection terminal mounted in the connector body, respectively, in a manner that at least parts thereof externally protrude, and configured to be brought into contact with the first socket terminal and the second socket terminal provided at the power supply unit, respectively, when the at least part of the connector body is inserted into the accommodating portion.

The connection unit may further include an elastic member supported by the storage unit and the connector body, respectively, such that a predetermined part of the connector body is inserted or drawn out through a through hole provided at the storage unit.

The connector body may include a first part formed to be insertable through the through hole, and a second portion extending with a sectional area greater than that of the first part and supporting one end portion of the elastic member. The first connection terminal and the second connection terminal may be installed in the second portion.

The storage unit may be provided with insertion holes communicating with the through hole. Protrusions may protrude from an outer circumference of the first part to correspond to the insertion holes, respectively, and be locked at the storage unit when the connector body is rotated after the protrusions are inserted through the insertion hole.

The storage unit may be provided with ribs covering both sides of each of the protrusions locked at the storage unit to restrict a rotation of the connector body.

The second portion may be provided therein with a partition wall formed of an insulating material, and having both side surfaces supporting the first connection terminal and the second connection terminal.

The connector body may include a first cover covering an opening formed at the first part and having holes for insertion of the wires therethrough, the wires electrically connected to the first and second connection terminals, respectively, and a second cover covering an opening formed at the second portion for installation of the first and second connection terminals.

In another exemplary embodiment, the refrigerator may further include a light source disposed at the storage unit, and configured to emit light by receiving power when the power supply unit and the connection unit are electrically connected.

The refrigerator may further include a light guide member disposed at the storage unit and configured to guide light emitted from the light source to illuminate the storage unit.

In accordance with at least one embodiment, when a storage unit is moved toward a rear wall within a refrigerator main body and completely installed thereat, an electrical connection between a power supply unit and a connection unit may simultaneously be carried out. Therefore, a separate power connection process, except for the installation of the storage unit, may not be needed, thereby improving assembly convenience.

Further scope of applicability of the present application may become more apparent from the detailed description given hereinafter. However, it should be understood that the detailed description and specific examples, while indicating preferred embodiments, are given by way of illustration only, since various changes and modifications within the spirit and scope of embodiments may become apparent to those skilled in the art from the detailed description.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a refrigerator main body having an opening and a rear wall;

a door coupled to the refrigerator main body, and the door is to open and close the opening;

a storage device to move toward the rear wall within the refrigerator main body;

a power supply device at the rear wall and having an accommodating portion to face the opening; and a connection device at the storage device, wherein when the storage device is moved to the rear wall and provided in the refrigerator main body, at least part of the connection device is inserted into the accommodating portion to be electrically connected to the power supply device, wherein the connection device includes:

a connector body at the storage device, and the connector body is configured such that at least part of the connector body is inserted into the accommodating portion when the storage device is provided in the refrigerator main body;

a first connection terminal and a second connection terminal in the connector body, respectively, and to contact a first socket terminal and a second socket terminal provided at the power supply device, respectively, when the at least part of the connector body is inserted into the accommodating portion; and a partition wall in the connector body between the first connection terminal and the second connection terminal, the partition wall being formed of an insulating material and having side surfaces supporting the first connection terminal and the second connection terminal, and wherein each of the first and second connection terminals is formed of a metallic member bent a plurality of times, and has a configuration that both end portions thereof are elastically supported by the partition wall and at least part thereof is protruded from an outer circumference of the connector body through a hole.

2. The refrigerator of claim 1, wherein the power supply device includes:

a socket body at the rear wall, and the socket body to receive the accommodating portion therein; and a first socket terminal and a second socket terminal at the socket body, and each having at least a part protruding into the accommodating portion, the first socket terminal being spaced from the second socket terminal.

3. The refrigerator of claim 2, wherein the storage device includes a recess portion recessed into a rear surface facing the rear wall such that at least part of the socket body is provided therein when the power supply device is electrically connected to the connection device.

4. The refrigerator of claim 2, wherein the socket body includes:

a first body portion, wherein the first socket terminal and the second socket terminal are disposed at the first body portion; and a second body portion extending from the first body portion to be externally inclined, and the second body portion to guide an insertion of the connection device.

5. The refrigerator of claim 4, wherein the first body portion includes first insertion recesses and second insertion recesses, in which first end portions and second end portions of the first and second socket terminals are inserted, respectively, such that the first and second socket terminals are attached.

6. The refrigerator of claim 5, wherein the second insertion recess extends in a different direction than the second insertion recess.

7. The refrigerator of claim 5, wherein the power supply device includes wires inserted into one of the first and second insertion recesses, and the wires are electrically connected to the first and second socket terminals, respectively.

8. The refrigerator of claim 4, wherein the second body portion is adhered to the storage device upon electric connection between the power supply device and the connection device.

9. The refrigerator of claim 4, wherein the storage device has a width corresponding to a distance between side walls in the refrigerator main body, the storage device to be guided by the side walls to move toward the rear wall, and wherein the second body portion has a width thereof in up and down directions that is wider than a width thereof in left and right directions.

10. The refrigerator of claim 9, wherein the first body portion has a width thereof in the up and down directions that is wider than a width of the connection unit in the up and down directions.

11. The refrigerator of claim 10, wherein the first and second socket terminals are disposed at sides of the first body portion such that the second socket terminal faces the first socket terminal, and wherein each of the first and second socket terminals extends in the up and down directions of the first body portion.

12. The refrigerator of claim 1, wherein the connection device includes an elastic member supported by the storage device and the connector body, respectively, such that a predetermined part of the connector body is inserted or drawn out through a through hole at the storage device.

13. The refrigerator of claim 12, wherein the connector body includes:

a first part to be insertable through the through hole; and a second portion to extend with a sectional area greater than a sectional area of the first part and supporting one end portion of the elastic member, wherein the first connection terminal and the second connection terminal are installed at the second portion.

14. The refrigerator of claim 13, wherein the storage device includes insertion holes communicating with the through hole, and wherein protrusions protrude from an outer circumference of the first part to correspond to the insertion holes, respectively, and the protrusions are locked at the storage device when the connector body is rotated after the protrusions are inserted through the insertion hole.

15. The refrigerator of claim 14, wherein the storage device includes ribs covering sides of each of the protrusions locked at the storage device to restrict rotation of the connector body.

16. The refrigerator of claim 13, wherein the connector body includes:

a first cover for covering an opening at the first part and having holes for insertion of wires therethrough, the wires electrically connected to the first and second connection terminals, respectively; and a second cover for covering an opening formed at the second portion for installation of the first and second connection terminals.

17. The refrigerator of claim 1, further comprising a light source at the storage device, and the light source to emit light by receiving power when the power supply device is electrically connected to the connection device.

18. The refrigerator of claim 17, further comprising a light guide member at the storage device, and the light guide member to guide light emitted from the light source to illuminate the storage device.

19. The refrigerator of claim 13, wherein the partition wall is provided in the second portion.

* * * * *